US005943959A

United States Patent [19]

Skumawitz

[11] Patent Number: 5,943,959

[45] Date of Patent: Aug. 31, 1999

[54] PARTIALLY SPRUNG DRIVE, IN PARTICULAR FOR ELECTRIC TRACTION VEHICLES

[75] Inventor: Erwin Skumawitz, Berlin, Germany

[73] Assignee: ABB Daimler-Benz Transportation (Deutschland) GmbH, Hennigsdorf, Germany

[21] Appl. No.: 08/875,740

[22] PCT Filed: Jan. 24, 1996

[86] PCT No.: PCT/EP96/00275

§ 371 Date: Oct. 27, 1997

§ 102(e) Date: Oct. 27, 1997

[87] PCT Pub. No.: WO96/23687

PCT Pub. Date: Aug. 8, 1996

[30] Foreign Application Priority Data

Feb. 4, 1995 [DE] Germany ..... 195 04 766

[51] Int. Cl.[6] ..... B61C 17/00

[52] U.S. Cl. ..... 105/133

[58] Field of Search ..... 105/133, 136, 105/139, 140

[56] References Cited

U.S. PATENT DOCUMENTS 4,697,527 10/1987 Eichinger ..... 105/133

FOREIGN PATENT DOCUMENTS 1214263 4/1966 Germany .
9116159 4/1992 Germany .
247156 11/1947 Switzerland .
797934 1/1981 U.S.S.R. ..... 105/133
803883 11/1958 United Kingdom .
2257101 1/1993 United Kingdom ..... 105/133

*Primary Examiner*—S. Joseph Morano
*Attorney, Agent, or Firm*—Venable; George H. Spencer; Norman N. Kunitz

[57] ABSTRACT

A partially spring-loaded drive, particularly for electrically-powered rail vehicles, having a gear which, including an encapsulating gear housing, is seated on the wheel axle, and a pinion that is seated in the gear housing. The coupled motor is fixedly secured to the truck, and the resilient, elastic fastening of the gear housing to the truck is effected by way of at least two elastic spring elements that are mounted nearly vertically and diametrically opposite the pinion shaft, and whose lines of influence extend through the center of the pinion shaft. To avoid the disadvantages associated with truck-side pendulum suspensions of the drive housing outside of the pinion shaft, and provide a solution to the fastening of the gear housing to the truck, with which a stabilizing effect can be achieved for protecting the bearings in addition to an economical minimization of deformation losses of the coupling, a defined radial prestressing of the gear housing (3) with respect to the wheel set (4/5) is established using the transverse elasticity of the spring elements (6). The radial prestressing can usefully be established above and below the gear housing (3) by way of an arrangement of rubber thrust springs having support surfaces.

2 Claims, 1 Drawing Sheet

PARTIALLY SPRUNG DRIVE, IN PARTICULAR FOR ELECTRIC TRACTION VEHICLES

BACKGROUND OF THE INVENTION

The invention relates to a partially spring-mounted drive, particularly for electrically-powered rail vehicles, of the type having a gear which, including an encapsulating gear housing, is seated on the wheel axle, and a pinion that is seated in the gear housing, with the coupled motor being fixedly secured to the truck and the resilient, elastic fastening of the gear housing to the truck being effected by at least two elastic spring elements that are mounted nearly vertically and diametrically opposite the pinion shaft, and whose lines of influence extend through the center of the pinion shaft. A drive of this type is known from the document DE-A-91 16 159.

There are numerous embodiments of partially spring-mounted drives having a transverse traction motor. In a drive according to DE-AS 12 14 263, the gear, including an encapsulating gear housing, is seated on the wheel axle, and the motor pinion or pinion is seated in the gear housing. In this instance, the motor is fixedly secured to the truck, and the gear housing is movably secured. On the one hand, a pendulum-motion suspension is effected via a connecting rod and, on the other hand, a resilient, elastic support against the truck is effected by way of two elastic spring elements that are mounted nearly vertically and diametrically (central-symmetrically) opposite the pinion shaft, and whose lines of influence extend through the center of the pinion shaft. A coupling is also typically disposed between the motor and the motor pinion or pinion.

The document mentioned at the outset, DE-A-91 16 159, discloses an axle drive, particularly for a rail vehicle wheel-set axle disposed in a truck, in which the axle of the drive motor extends parallel to the wheel-set axle, and the motor, which drives the wheel-set axle by way of a spur gear that is fixedly connected to the wheel-set axle, also drives a universal coupling and is fixedly connected to the truck. The wheel-set axle is resiliently connected to the truck in such a way that the spring path is larger by a multiple in the one, direction that is, the vertical direction, than in the other, direction that is, the horizontal direction. The spur gear is supported opposite the truck by means of a torque-converter bearing provided with universal joints. The axis of the torque-converter bearing intersects the axis of the drive shaft of the spur gear approximately perpendicularly, or passes close by it and extends in the direction of the largest spring path of the wheel-set axle. Thus, a fixing resilience of the universal joints at the ends of the torque-converter bearing is provided that permits, above all, a resilience in the vertical direction, while the transverse resilience permits only a very limited horizontal flexibility for the purpose of fixing the torque-converter bearing.

These constructions have system-stipulated disadvantages. With the increase in driving speeds and motor rpms over time in the quest for more lightweight construction, the motor bearings can be reduced in desirable fashion, but the gear bearings must retain their size due to the predetermined axle loads, or even be enlarged because of larger axle diameters. Because of high rpms in the event of a drive power outage, these bearings are in great danger because a stabilizing radial load is no longer present on account of the small gear mass that is to be provided for the high-speed range.

It is the object of the invention to remedy this situation and provide a simple fastening of the gear housing to the truck with which a stabilizing effect can be attained for protecting the bearings, in addition to an economical minimization of the deformation losses of the coupling.

SUMMARY OF THE INVENTION

The above object generally is accomplished according to the present invention by providing a spring loaded drive of the type initially described above with a defined radial prestressing of the gear housing with respect to the wheel set with the prestressing being established by the transverse elasticity of the spring elements.

Advantageous embodiments and modifications likewise are disclosed.

The invention is described in detail below by way of an embodiment.

DETAILED DESCRIPTION OF THE PREFERRED EMBODIMENTS

Figure 1:
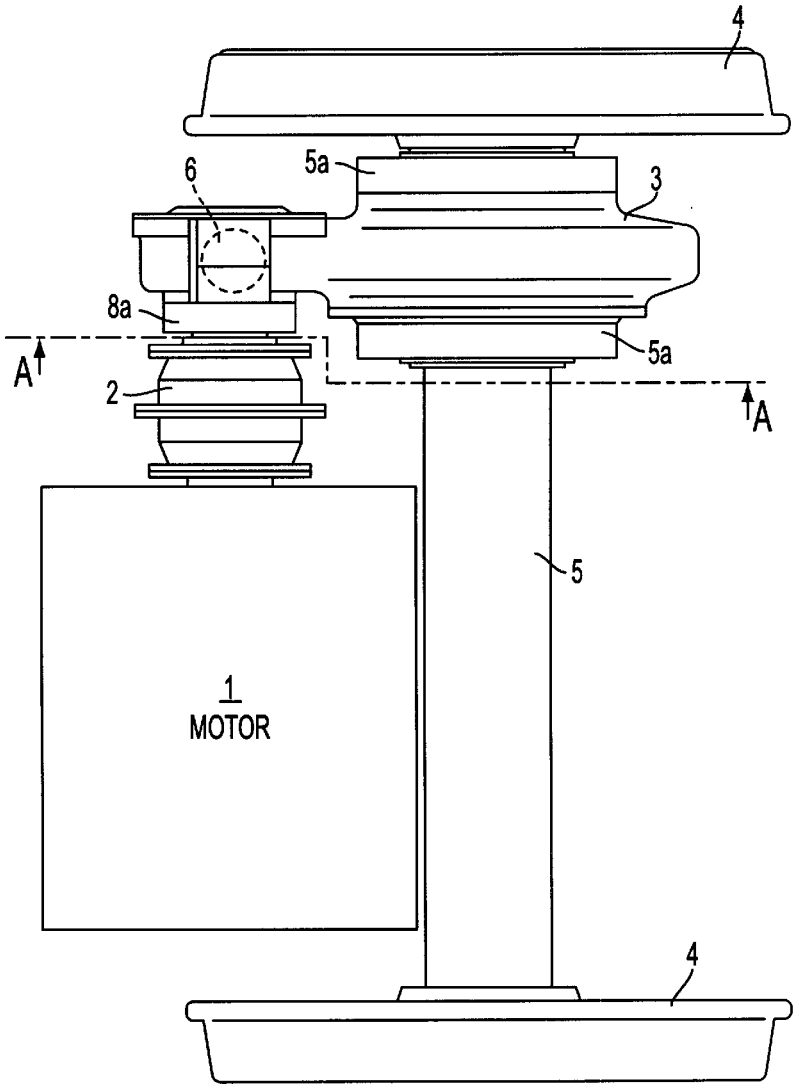
FIG. 1 is a plan view of a drive having a motor and a wheel set.

FIG. 1 shows the complete drive for a wheel set having a motor 1, which, via a coupling 2, drives a pinion, not visible, that is encapsulated in a gear housing 3. The pinion meshes with a gear, not visible, that is connected to a traction wheel 4 of the wheel set in the gear housing 3, which itself is seated on the wheel-set axle 5. The motor 1 is fixedly anchored in the truck. The gear housing 3 is closed by a oil pan 9 having a viewing glass 10 and a waste-oil screw 11.

Figure 2:
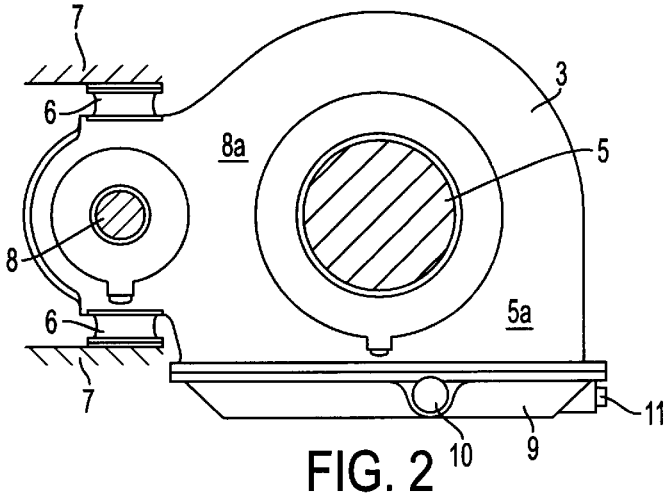
FIG. 2 is a sectional view along the sectional plane A-A in FIG. 1 (view does not include wheel set).

As can be seen particularly in the sectional view of FIG. 2—in which motor 1 and wheel set 4, 5 are omitted—the gear housing 3 is supported above and below against the truck 7 by way of two elastic spring elements 6 that are mounted vertically and diametrically opposite the pinion shaft 8, and the lines of influence of the spring elements 6, in this case rubber transverse springs, extend through the center of the pinion shaft 8. This results in a resilient, elastic fastening of the gear housing 3 with an imaginary inner system point of rotation that passes partly through the center line of the pinion shaft 8. Spring deflections of the wheel-set axle remain practically without effect on the pinion shaft 8, significantly reducing coupling wear. A defined prestressing of the gear housing 3 with respect to the wheel set 4/5 is established by a transverse elasticity of the spring elements 6. As a result, the bearings of the gear housing 3 on the wheel axle 5 retain the necessary minimum stress, even during no-load operation.

I claim:

1. A partially spring-loaded drive for electrically-powered rail vehicles, with said drive having a gear which, including an encapsulating gear housing, is mounted on a wheel axle, and a pinion that is mounted in the gear housing, and is coupled via a pinion shaft to a drive motor fixedly secured to a trucks and a resilient, elastic fastening of the gear housing to the truck effected by at least two elastic spring elements that are mounted nearly vertically and diametrically opposite the pinion shaft, and whose lines of influence extend through the center of the pinion shaft, and wherein the transverse elasticity of the springs is such that a desired defined and adjusted radial prestressing of the gear housing with respect to the respective wheel axle and attached wheels is provided.

2. A partially spring-loaded drive according to claim 1, wherein the radial prestressing is established above and below the gear housing by an arrangement of said elastic spring elements in the form of rubber transverse springs having support surfaces engaging the gear housing.

* * * * *